United States Patent [19]

Lemler

[11] 4,345,631

[45] Aug. 24, 1982

[54] WOOD TURNING TOOL

[76] Inventor: Anton J. Lemler, Rte. 6, Box 144, Sedalia, Mo. 65301

[21] Appl. No.: 200,463

[22] Filed: Oct. 24, 1980

[51] Int. Cl.[3] ..... B25D 3/00

[52] U.S. Cl. ..... 145/24; 30/168; 145/26

[58] Field of Search ..... 145/115, 24, 25, 26; 30/168; 81/3.46 R

[56] References Cited

U.S. PATENT DOCUMENTS

| | | | |
|---|---|---|---|
| 22,863 | 2/1859 | Fisher | 145/24 |
| 93,534 | 8/1869 | Hinz | 145/25 |
| 232,634 | 9/1880 | Durgin | 145/26 |
| 1,498,753 | 6/1924 | Rendlich | 30/315 |

FOREIGN PATENT DOCUMENTS

| | | | |
|---|---|---|---|
| 13679 | of 1895 | United Kingdom | 145/24 |

OTHER PUBLICATIONS

Prechtl's Technologische Encyklopaedie, vol. 3-4, Plates, 145-24.

*Primary Examiner*—Stephen G. Kunin
*Assistant Examiner*—J. T. Zatarga
*Attorney, Agent, or Firm*—Schmidt, Johnson, Hovey & Williams

[57] ABSTRACT

A chisel for turning a workpiece spindle has a semi-circular template notch in one end of an elongated blade in combination with a cutting edge and guiding tongue. A beveled portion of the narrow blade forms the cutting edge at one terminus of the notch, and the tongue extends outwardly from the other terminus in diametrically opposed relationship to the cutting edge. The rotating spindle is guided into the constant radius notch by the tongue to permit cutting of a variety of intricate contours in the spindle without gouging and assuring accuracy and reproducibility in turning operations.

1 Claim, 5 Drawing Figures

WOOD TURNING TOOL

Turning workpiece spindles in a lathe using conventional, flat chisels in an ancient art. Frequently, the chisel is held against the rotating spindle, and the artisan's skill determines the accuracy and reproducibility of contours cut in the workpiece. Gouging is an ever present risk, and turning operations are frequently interrupted to measure the contour's size with a caliper.

More recently, diameter boards have obviated the necessity of calipers to determine contour size. Outwardly extending, gouge-preventing tongues, such as described in U.S. Pat. No. 204,485, have been employed to eliminate the need for tool rests. Jaw-like turning tools with adjustable cutting edges have been developed in an attempt to eliminate both calipers and rests, e.g. U.S. Pat. Nos. 232,634; 262,218; 403,521 and 846,272, as well as France Pat. No. 143,779.

These foregoing solutions have only been partial. Jaw-like, adjustable devices have the dual drawbacks of unwieldy width and slippage of the variable setting after prolonged use.

The present invention solves the multifarious problems of the prior art by combining a template notch, cutting edge and steadying tongue in one end of an elongated chisel blade. The notch has a concave wall which merges with a beveled portion of the blade to form a cutting edge. The supporting tongue extends outwardly from the opposite terminus of the notch, guiding and steadying the blade as controlled bites are taken into the workpiece.

The fixed radius of the notch is a diameter-determining gauge eliminating the need for outside calipers. Elimination of variable settings assures accuracy and reproducibility of contours. A selection of tools each with a different fixed radius may be used to form a variety of intricate turnings, thus maintaining versatility while eliminating hazards of adjustability. The absence of set screws allows a narrower blade, permitting the cutting edge to reach closer to the longitudinal axis of the workpiece spindle.

The present improvement is a significant advance over U.S. Pat. No. 262,318 to Geiger which discloses a cutting tool with a slotted body and adjustable cutting edge. The edge is movable within the slot and is not integral with the blade. In contrast, the instant invention is solid throughout, presenting an uninterrupted, transversely flat, concave wall defining the notch.

U.S. Pat. No. 221,552 to Hanson discloses a unitary tool presenting a parabolic notch having jagged cutting elements protruding from both termini of the notch. The transversely flat, concave wall defining the notch in the present invention differs from Hanson's parabolic notch. The jagged, protruding cutting edges contrast sharply with the uninterrupted, linear, transversely extending edge employed in my improved combination.

Figure 1:
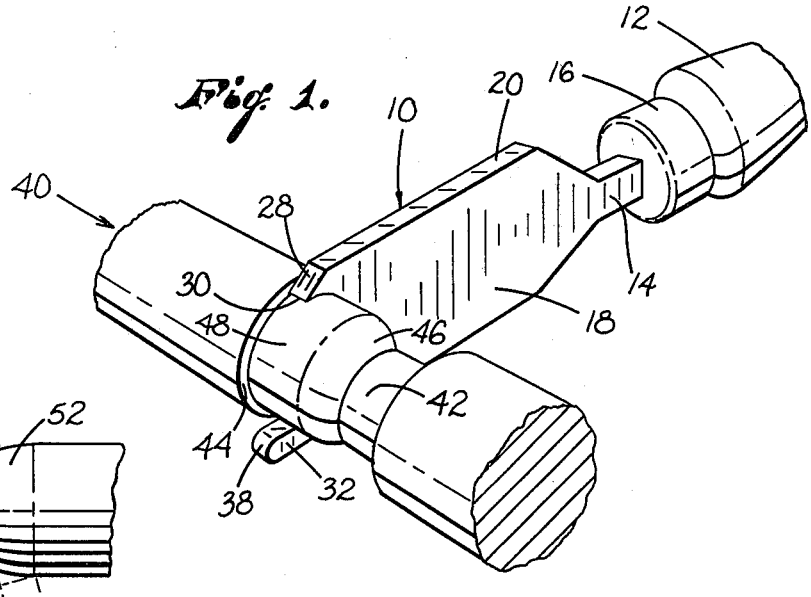
FIG. 1 is a fragmentary perspective view of the wood turning tool of the present invention in cutting engagement with a workpiece spindle.

The tool illustrated in the drawing includes a blade in the nature of an elongated bar 10 provided with a handle 12 at one end thereof receiving a reduced portion or shank 14 of the bar 10, the handle 12 and the shank 14 being surrounded by the tool ferrule 16.

The bar 10 is essentially rectangular as shown, presenting a pair of opposed, flat, parallel sides 18 and a pair of opposed, parallel, flat, relatively narrow edges 20 and 22 perpendicular to the sides 18.

The free end of the bar 10 opposite to the shank 14 is provided with a semi-circular, template notch 24 having an uninterrupted transversely flat concave wall 26 defining the notch 24 which is, manifestly, perpendicular to the sides 18.

The bar 10 which is otherwise solid and imperforate throughout is provided with a beveled portion 28 at its free end which merges with the notch 24 at the normally uppermost terminus of the notch 24, presenting a sharp, leading cutting edge 30 which extends transversely of the bar 10 uninterrupted and linearly across the bar 10 in perpendicular relationship to the sides 18. Noteworthy also is the fact that the normally uppermost edge 20 of the bar 10 merges with the beveled portion 28.

The bar 10 is also provided with an elongated imperforate tongue 32 at its free end, the tongue 32 being integral with the bar 10. The tongue 32 extends outwardly beyond that terminus of the notch 24 opposite to the cutting edge 30 and in diametrically opposed relationship to the latter. The tongue 32 is essentially square in transverse cross-section and has a flat inner surface 34 parallel with the longitudinal axis of the bar 10. The edge 22 of the bar 10 has a stretch 36 in opposed parallel relationship to the surface 34 and the tongue 32 terminates in a convex tip 38, the latter of which is transversely perpendicular to the sides 18, and therefore, to the sides of the tongue 32.

Figure 2:
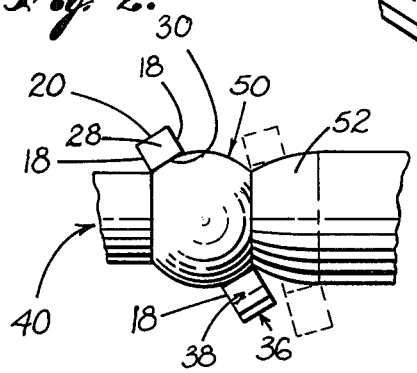
FIG. 2 is an end view of the tool as it is applied to the workpiece spindle.
Figure 3:
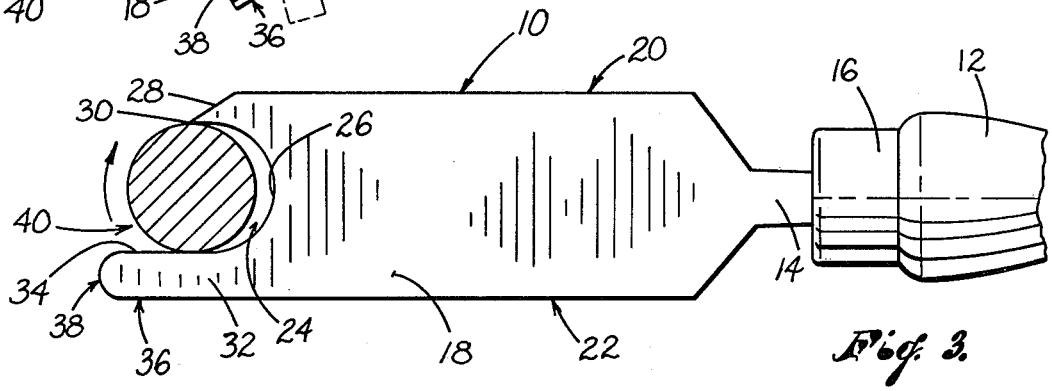
FIG. 3 is an enlarged, fragmentary, side elevational view of the tool, showing the workpiece spindle in cross-section.
Figure 4:
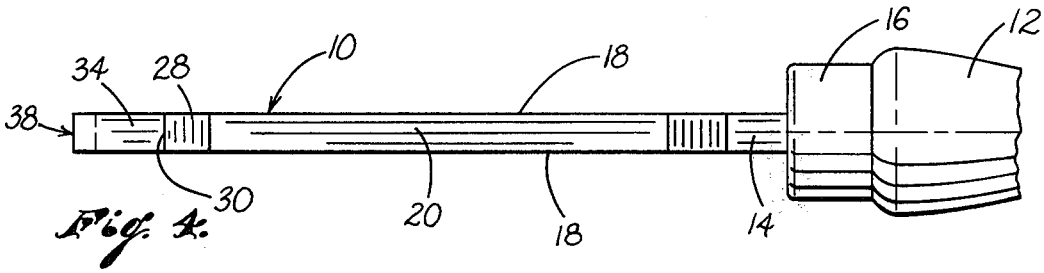
FIG. 4 is a fragmentary view of the tool showing the normally top edge thereof.
Figure 5:
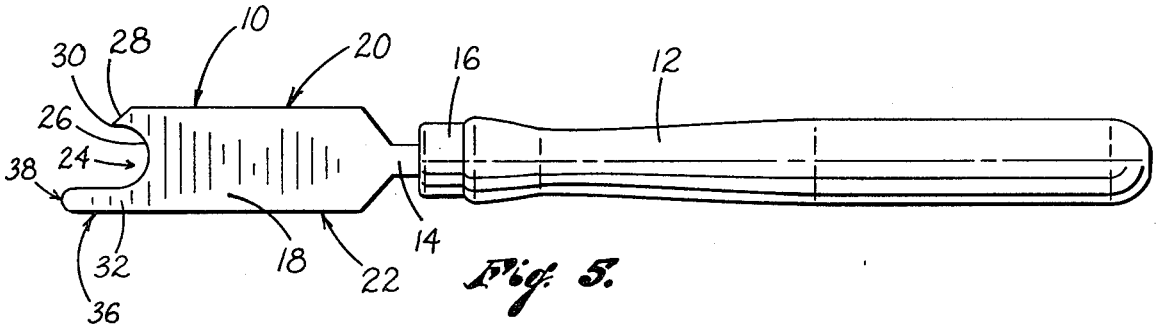
FIG. 5 is a side elevational view of the tool on a reduced scale.

The tool is shown in FIGS. 1–3 in operative association with an elongated spindle 40 that is commonly held within a lathe (not shown) and rotated by the lathe about its longitudinal axis in a clockwise direction (viewing FIG. 3), the spindle 40 being made, for example, from wood. The tool is moved into cutting relationship to the spindle 40 by the user grasping the handle 12, as best depicted in FIGS. 1 and 2, in a manner to normally bring the tongue 32 into underlying relationship to the spindle 40 such that the latter engages the surface 34 and, in this regard, the configuration of the tip 38 is important because it avoids any tendency of the tongue 32 to gouge into the spindle 40 as would otherwise be likely if the tip 38 were provided with sharp edges especially at the zone of merger between the surface 34 and the tip 38.

With the surface 34 thus engaging the spindle 40, the user is initially assured of the tool being in proper relationship with the spindle 40 for commencing the cutting operations. The tongue 32 serves, therefore, as a guide and operates to steady the tool so as to permit the user to thereupon bring the cutting edge 30 into cutting relationship to the spindle 40 as lightly as he may so desire, again eliminating any tendency for the cutting edge 30 to gouge into the spindle 40, thereby cutting too deeply. Moreover, those familiar with turning operations generally can appreciate that unless extreme care is taken, a rapidly spinning spindle 40 can actually dislodge the tool from the hand of the operator causing injury to him and damage to the spindle 40 itself.

Accordingly, as use of the tool continues various shapes and contours can be cut into the spindle 40, including vees, tapers, bevels, reeds, flutes, covers, grooves, undercuts and various other well-known configurations.

Illustrated, therefore, by way of example only is a reduced diameter portion 42, a shoulder 44, and a curve 46 in FIG. 1 all of which may be formed by the tool. It is to be noted also in FIG. 1 that portion 48 of the spindle 40 has the same size and configuration as the notch 24 by virtue of the fact that the cutting can continue until such time as the notch 24 serves as a template gauge thereby eliminating the need for measuring through use of conventional outside calipers. On the other hand, the portion 42 might be formed in the same manner through use of a like tool wherein the template notch thereof has an appreciably smaller diameter.

FIG. 2 illustrates somewhat schematically the way in which the tool 10 may be turned or rotated in relationship to the spindle 40 such as to form a contour or bead 50 as well as an adjacent taper 52, it being understood that in performing the operation depicted by FIG. 2, it is the cutting edge 30 only which cuts into the spindle 40 while the tongue 32 continues to serve as a guide with the notch 24 determining the ultimate desired diameter of the portions to be turned on or into the spindle 40. In regard further to FIG. 2, it is to be noted that the direction of rotation of the handle 12 by the operator may be either to the right or to the left, as clearly shown in FIG. 2, depending upon the nature of the particular contour being formed.

I claim:

1. In a chisel for turning a workpiece spindle in a lathe, a chisel blade comprising:

an elongated flat bar having a semi-circular, template notch in one end thereof for clearing the workpiece and gauging the size and configuration of contours to be cut into the workpiece by the chisel, said end having a beveled portion merging with said notch at one terminus of the latter presenting a sharp, leading cutting edge extending transversely of the bar and integral therewith; and an elongated, imperforate tongue at said end, integral with the bar and extending outwardly beyond the opposite terminus of said notch in diametrically opposed relationship to said edge for guiding the chisel during turning of the workpiece into an operating position for cutting said contours, said bar having a pair of opposed, flat parallel sides, said wall being perpendicular throughout to said sides and having a pair of opposed, flat parallel edges perpendicular to said sides, one of said parallel edges merging with said beveled portion, the other of said parallel edges having a stretch in opposed parallel relationship to said surface, the bar being solid throughout, presenting an uninterrupted, transversely flat, concave wall defining said notch, said tongue having a flat, workpiece-engaging surface parallel with the longitudinal axis of the bar, the tongue terminating in a convex tip transversely perpendicular to said sides, said cutting edge extending uninterruptedly and linearly across the bar in perpendicular relationship to said sides and being in a predetermined fixed position with respect to said tongue.

* * * * *